US006722111B1

(12) United States Patent
Herava

(10) Patent No.: US 6,722,111 B1
(45) Date of Patent: Apr. 20, 2004

(54) RING FOR A WRAPPING APPARATUS AND A METHOD FOR MANUFACTURING THE SAME

(75) Inventor: Ismo Herava, Naantali (FI)

(73) Assignee: United Packaging PLC, West Yorkshire (GB)

( * ) Notice: Subject to any disclaimer, the term of this patent is extended or adjusted under 35 U.S.C. 154(b) by 0 days.

(21) Appl. No.: 10/129,526

(22) PCT Filed: Nov. 9, 2000

(86) PCT No.: PCT/FI00/00978

§ 371 (c)(1),
(2), (4) Date: May 7, 2002

(87) PCT Pub. No.: WO01/34472

PCT Pub. Date: May 17, 2001

(30) Foreign Application Priority Data

Nov. 9, 1999 (FI) ..... 19992415

(51) Int. Cl.[7] ..... B65B 13/12
(52) U.S. Cl. ..... 53/588
(58) Field of Search ..... 53/587, 588, 589; 100/27, 28

(56) References Cited

U.S. PATENT DOCUMENTS 4,110,957 A * 9/1978 Lancaster et al. ..... 53/589
4,117,650 A * 10/1978 Ito et al. ..... 53/587
5,421,141 A * 6/1995 Gordon ..... 53/588
5,878,555 A * 3/1999 Turfan et al. ..... 53/588
6,386,955 B2 * 5/2002 Zuniga et al. ..... 451/56
6,574,941 B1 * 6/2003 Neri ..... 53/588
6,601,377 B2 * 8/2003 Tsukamoto ..... 57/200

FOREIGN PATENT DOCUMENTS

EP 0 747 287 A1 12/1996
EP 0 811 554 A1 12/1997

* cited by examiner

*Primary Examiner*—John Sipos
(74) *Attorney, Agent, or Firm*—Kubovcik & Kubovcik

(57) ABSTRACT

A ring member (10) of reinforced plastic construction for a wrapping machine, said ring member comprising a box-shaped portion (15) having a plurality of reinforcing fibre layers so arranged that the fibre directions are varied so as to achieve a sufficient strength and flexural rigidity, and a core part (17) of cellular plastic. The walls (14) of the box-shaped portion may deviate from a vertical or horizontal plane, and the wall may be provided with one or more flanges (16) oriented in a direction outward from the ring member or toward the center of the ring member. The box-shaped portion is preferably made of carbon fibre and epoxy resin, and the core part inside the box-shaped portion is of foamed polyurethane plastic. Inside the reinforcing plastic layers of the box-shaped portion it is also possible to laminate a steel reinforcement (18), to which a wrapping film feed apparatus (20) and possibly support rollers are fastened.

11 Claims, 8 Drawing Sheets

RING FOR A WRAPPING APPARATUS AND A METHOD FOR MANUFACTURING THE SAME

SUBJECT OF THE INVENTION

The invention concerns a ring member of reinforced plastic construction for a wrapping machine, said ring member being rotatable and having a mainly ring-shaped structure.

The invention is associated with a wrapping machine whose wrapping unit comprises a rotatable wrapping ring member. The wrapping ring member has the shape of a circular ring and, usually supported by rollers, rotates in the wrapping machine either in a horizontal plane or in a vertical plane, while the object to be wrapped is wrapped by means of a plastic film band roll rotating with the ring member.

BACKGROUND OF THE INVENTION

The wrapping ring member is usually made of a metallic material, but wrapping ring members of reinforced plastic construction are also used. A wrapping ring member of reinforced plastic construction is presented in patent EP 0 747 287 A1. However, a reinforced plastic structure has generally not proved to be strong enough to withstand the stresses caused by the roll of plastic film band rotating with the wrapping ring. It has been established that, especially as the rotational speed increases, the reinforced plastic structure is bent, causing problems. On the other hand, if the wrapping ring member of reinforced plastic is implemented as a very massive structure, then it will be difficult to manufacture, so this is economically not sensible.

OBJECT OF THE INVENTION

The object of the present invention is to achieve a new type of wrapping ring member of reinforced plastic, which does not have the disadvantages, described above.

FEATURES CHARACTERISTIC OF THE APPARATUS OF THE INVENTION

The wrapping ring member of the invention for a wrapping machine is characterized in that the ring member of reinforced plastic construction for a wrapping machine comprises a box-shaped portion having a plurality of reinforcing fibre layers laminated in different directions upon a core part of cellular plastic or equivalent material, that the box-shaped portion of the ring member is provided with a reinforcement laminated inside the reinforced plastic layers in the box-shaped portion, said reinforcement being preferably made of steel, and that the reinforcement is a ring of the same form with the ring member or its length only equals part of the length of the ring member.

In cross-section, the box-shaped portion of the ring-shaped member may be e.g. of a rectangular, polygonal or circular form. Other forms different from these are also possible. The essential point is that the form and structure of the ring member are designed to achieve a light and strong ring that is well able to withstand the centrifugal forces generated by the rotating ring member and the plastic film feed apparatus moving together with it.

EMBODIMENTS OF THE APPARATUS OF THE INVENTION

A preferred embodiment of the apparatus of the invention is characterized in that at least one of the reinforced plastic walls of the box-shaped portion of the ring member is inclined at an angle deviating form a vertical or horizontal plans.

A second preferred embodiment of the apparatus of the invention is characterized in that the reinforced plastic wall of the box-shaped portion of the ring member which is in engagement with a support roller and/or guide roller of the ring member is inclined at an angle of preferably 45° relative to the vertical plane.

A third preferred embodiment of the apparatus of the invention is characterized in that the reinforced plastic box-shaped portion of the ring member comprises at least one flange for support and/or guide rollers, which Is made of the same reinforced plastic material.

A fourth preferred embodiment of the apparatus of the invention is characterized in that the flange of the ring member is preferably oriented in a direction inward from the box-shaped portion toward the centre of the ring member or in the opposite direction, outward from the ring member. Yet the flange may also be oriented in any other direction that gives the ring member advantageous strength properties. Thus, the flange may be oriented e.g. in an upward or downward slanting direction.

A fifth preferred embodiment of the apparatus of the invention is characterized in that the box-shaped portion of the ring member comprises two or more flanges, which may either be all oriented in the same direction, partially in different directions or they all may be oriented in different directions.

A sixth preferred embodiment of the apparatus of the invention is characterized in that the reinforcing fibres in the box-shaped portion and/or flanges of the ring member are preferably carbon fibres, the binding agent binding the reinforcing fibres is preferably epoxy resin, and that the core part inside the box-shaped portion is preferably made of foamed polyurethane plastic.

A seventh preferred embodiment of the apparatus of the invention is characterized in that it comprises at least one bolt going through the box-shaped portion of the ring member and through the core part of it, by means of which bolt the feed apparatus for a plastic film band roll can be connected to the ring member.

An eighth preferred embodiment of the apparatus of the invention is characterized in that it comprises at least one threaded sleeve or cup-like threaded part laminated inside the box-shaped portion of the ring member, to which threaded sleeve or part the feed apparatus of the plastic film band roll is connected with bolts.

A ninth preferred embodiment of the apparatus of the invention is characterized in that the reinforcement inside the ring member is provided with at least one threaded hole for the attachment of a feed apparatus for a plastic film band roll.

A tenth preferred embodiment of the apparatus of the invention is characterized in that it comprises one or more guide or support rollers connected either directly or via an adapter element to the box-shaped portion or flange of the ring member.

METHOD OF THE INVENTION

The invention also relates to a method for the manufacture of a ring member of reinforced plastic construction for a wrapping machine.

By prior-art manufacturing methods, it has not been possible to produce sufficiently strong ring members of reinforced plastic construction for a wrapping machine. Prior-art ring member structures are massive but still too flexible. The object of the present invention is to achieve a method that does not have the above-mentioned disadvantages.

FEATURES CHARACTERISTIC OF THE METHOD OF THE INVENTION

The method of the Invention is characterized in that the ring member of reinforced plastic construction for a wrapping machine is formed to a ring-like enclosure by laminating several reinforcing fibre layers in different directions upon a core part preferably made of cellular plastic or equivalent material, and that inside the reinforced plastic layers in the box-shaped portion is laminated a reinforcement, which is a ring of the same form with the ring member or its length only equals part of the length of the ring member, and being preferably made of steel.

A preferred embodiment of the method of the invention is characterized in that the ring member of reinforced plastic construction is manufactured by laminating the box-shaped portion upon the core part of cellular plastic or equivalent material by laminating several reinforcing fibre layers with varying fibre directions on top of each other, and after that, pressing the core part and the box-shaped portion laminated upon it against each other.

A second preferred embodiment of the method of the invention is characterized in that the ring member of reinforced plastic construction is manufactured by pressing, after lamination of the reinforced plastic layers of the box-shaped portion, the reinforced plastic layers onto the core part by means of presses.

A third preferred embodiment of the method of the invention is characterized in that a flange is formed in the box-shaped portion of reinforced plastic construction by laminating several reinforcing fibre layers with different fibre directions upon a core part of cellular plastic or equivalent material and bending the edges of the layers over each other to form a flange, whereupon the reinforcing fibre layers of the box-shaped portion are pressed upon the core part and the edges of the reinforcing fibre layers forming the flange are pressed against each other.

A fourth preferred embodiment of the method of the invention is characterized in that the ring member of reinforced plastic construction is manufactured by making the box-shaped portion and/or flanges by laminating several layers of carbon fibres with epoxy resin on top of each other upon a core part of foamed polyurethane plastic.

A fifth preferred embodiment of the method of the invention is characterized in that the ring member of reinforced plastic construction is manufactured by first laminating the box-shaped portion by laminating several reinforcing fibre layers with varying fibre directions on top of each other, and after that supplying foaming cellular plastic or equivalent material into the space inside the box-shaped portion.

EXAMPLES OF EMBODIMENTS

In the following, the invention will be described in detail by the aid of a few examples with reference to the attached drawings, wherein

LIST OF DRAWINGS

FIG. 1 presents a ring member for a wrapping machine in top view.

FIG. 2*a* presents a section through the ring member in FIG. 1, taken along line II–II FIG. 2*b* corresponds to FIG. 2*a* and presents a second embodiment of the ring member.

FIG. 3 corresponds to FIG. 2 and presents a third embodiment of the ring member.

FIG. 4 corresponds to FIG. 2 and presents a fourth embodiment of the ring member.

FIG. 5 corresponds to FIG. 2 and presents a fifth embodiment of the ring member.

FIG. 6 corresponds to FIG. 2 and presents a sixth embodiment of the ring member.

FIG. 7 corresponds to FIG. 2 and presents a seventh embodiment of the ring member.

FIG. 8 presents a cross-section of yet another embodiment of the ring member.

DESCRIPTION OF THE DRAWINGS

FIG. 1 shows one support roller 11 stabilising the ring member 10 from outside in a radial direction, and one support roller 12 supporting the ring member from below. In reality, there are a plurality of such rollers on different sides of the ring member 10.

Figure 1:
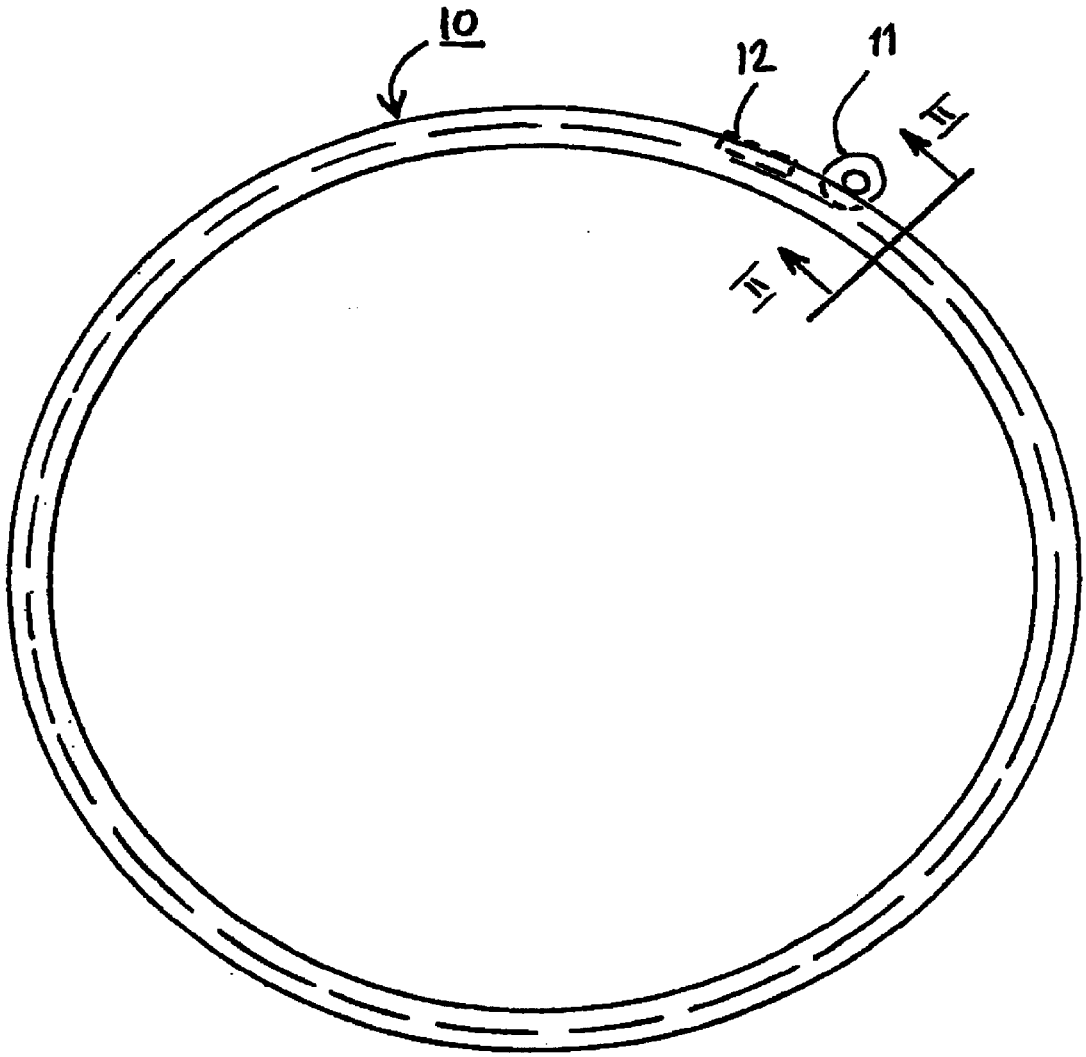
FIG. 1 presents the circular ring member 10 of a wrapping machine in top view. The figures do not show the frame of the wrapping machine or any other parts belonging to it. The rotating ring member 10 is usually suspended using a plurality of guide and support rollers mounted on the frame of the wrapping machine and engaging the ring member. For the sake of clarity.
Figure 2A:
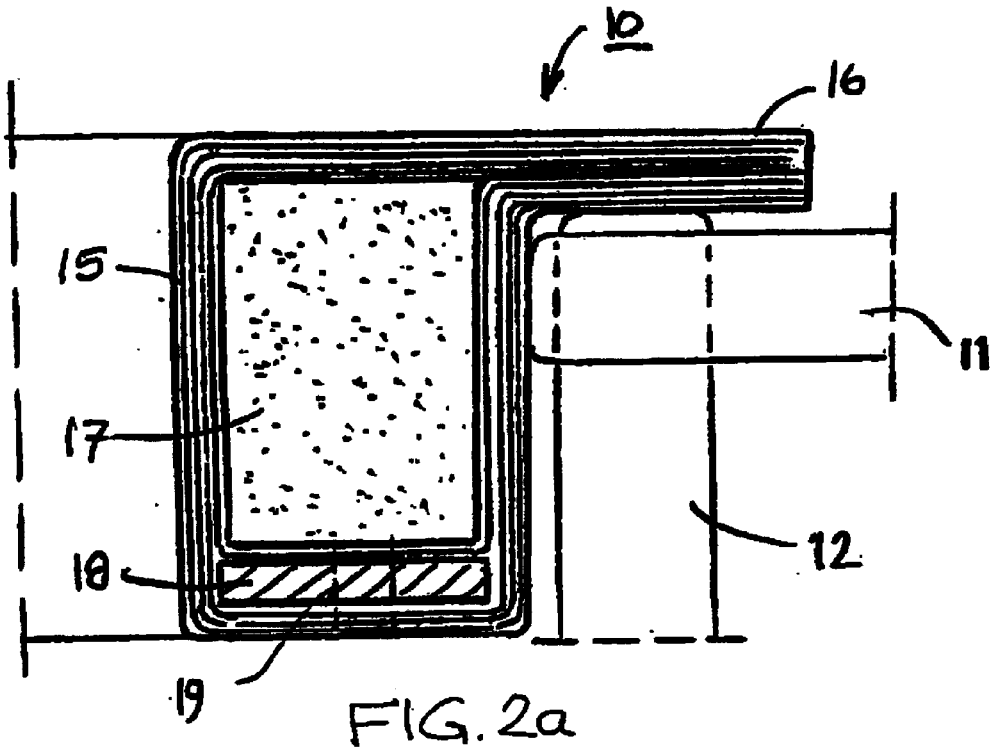
FIG. 2*a* presents a cross-section of the ring member 10 in FIG. 1, with support rollers 11 stabilising the ring member 10 from outside in a radial direction and support rollers 12 supporting the ring member 10 from below. As can be seen from FIG. 2*a*, the ring member 10 consists of a box-shaped portion 15 and a horizontal flange 16 incorporated with it. Both the box-shaped portion 15 and the flange 16 comprise several reinforcing fibre layers in which the fibres have been arranged in a varying manner in different directions in order to achieve a sufficient strength and flexural rigidity. The reinforcing fibres are preferably e.g. carbon fibres and the binding agent used with them is epoxy resin. The box-shaped portion 15 is filled with a lighter yet sufficiently strong filler 17, such as e.g. foamed polyurethane plastic.
Figure 2B:
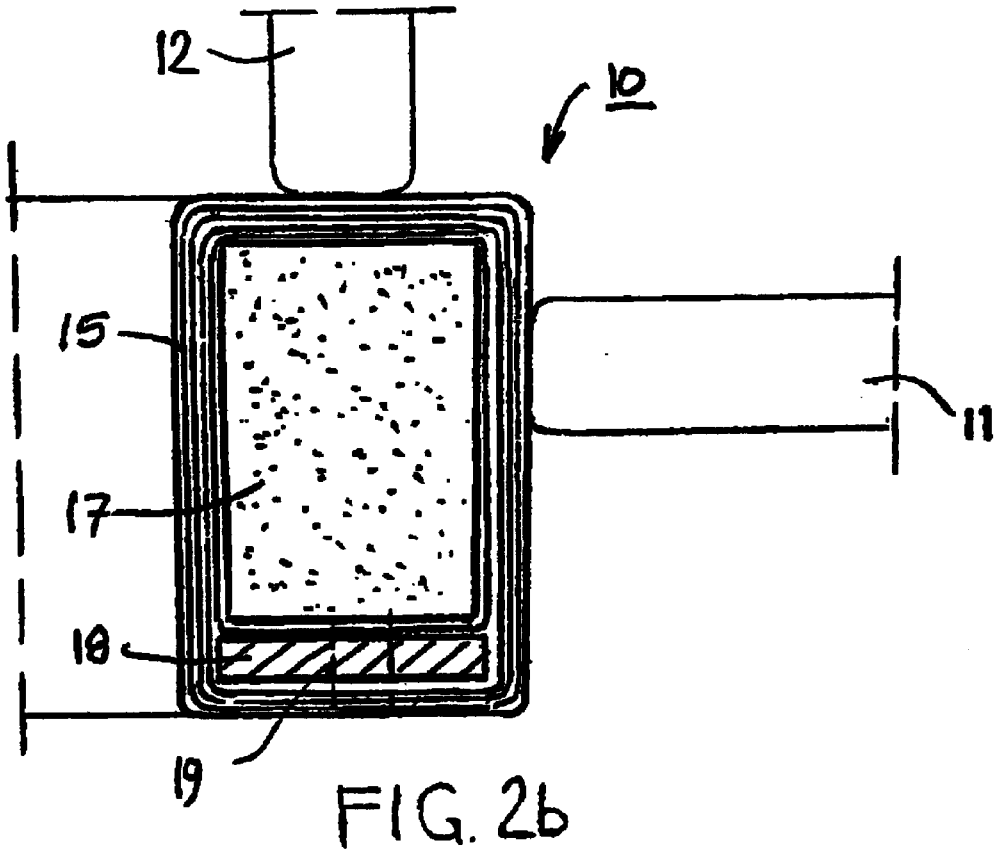

It is also possible to implement the ring member 10 as in FIG 2*b* so that it has no flange 16 at all. In this case, the guide and support rollers 11 and 12 engage the box-shaped portion 15 of the ring member 10 directly from different sides of it. The suspension of the ring member 10 can also be implemented In an inverse manner such that the guide and support rollers are fastened to the ring member 10 of the wrapping machine, either directly or via adapter elements. In this case, the rollers of the ring member 10 engage a second ring, which is not rotatable and is mounted on the frame of the wrapping machine. This embodiment is not presented in the drawings.

At the lower edge of the box-shaped portion 15 of the ring member 10 there is additionally a reinforcement 18, preferably of steel, laminated inside the reinforcing fibre layers. The reinforcement 18 may be a ring, but it may also only extend through part of the ring member 10. The reinforcement 18 can be provided e.g. with holes 19 drilled from outside the ring member 10 and the holes can be provided with threads, thus allowing a feed apparatus for a plastic film band roll or some other piece of equipment to be fastened to the ring member 10.

Figure 3:
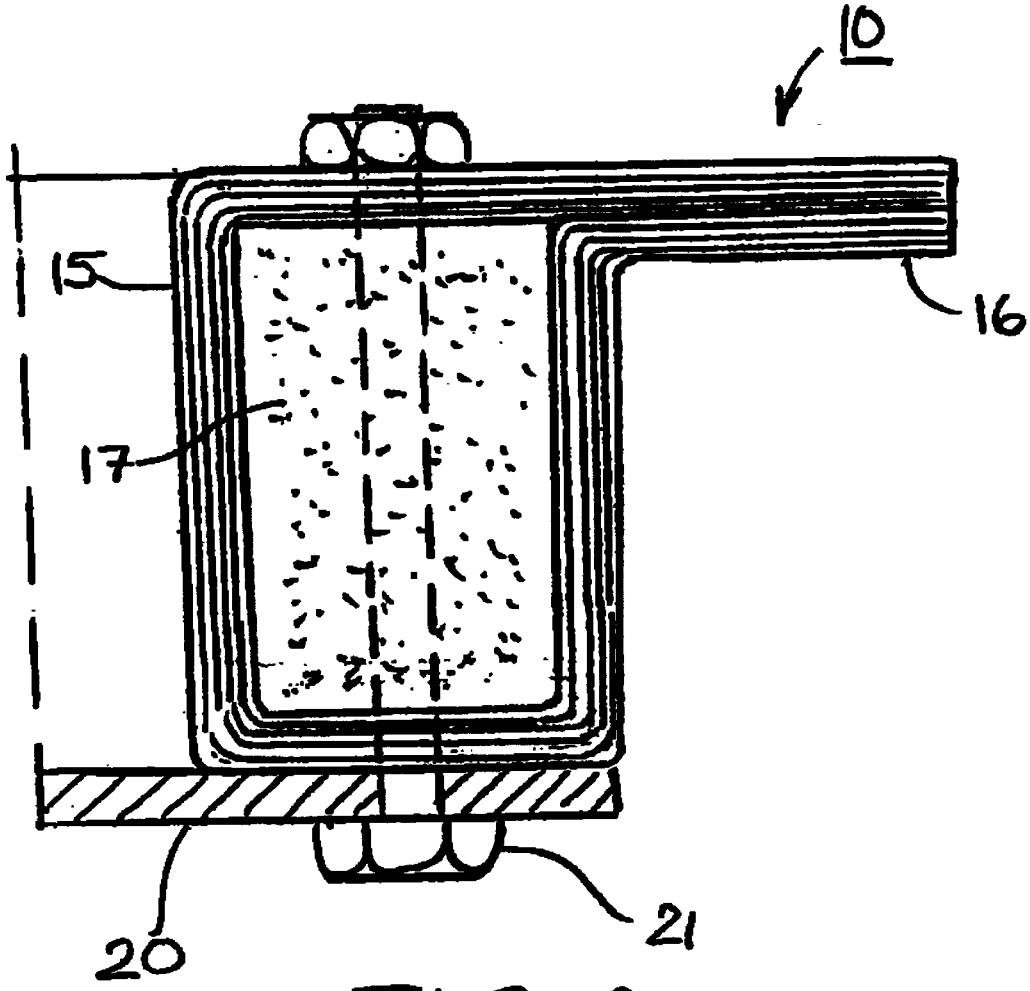

FIG. 3 presents a second embodiment of the ring member 10 for a wrapping machine, in which the box-shaped portion 15 of reinforced plastic only contains filler material 17 without a metallic reinforcement as presented in FIG. 2. In this case, a feed apparatus 20 for a plastic film band roll or other device to be attached can be fastened e.g. with bolts 21 going through the enclosure 15.

Figure 4:
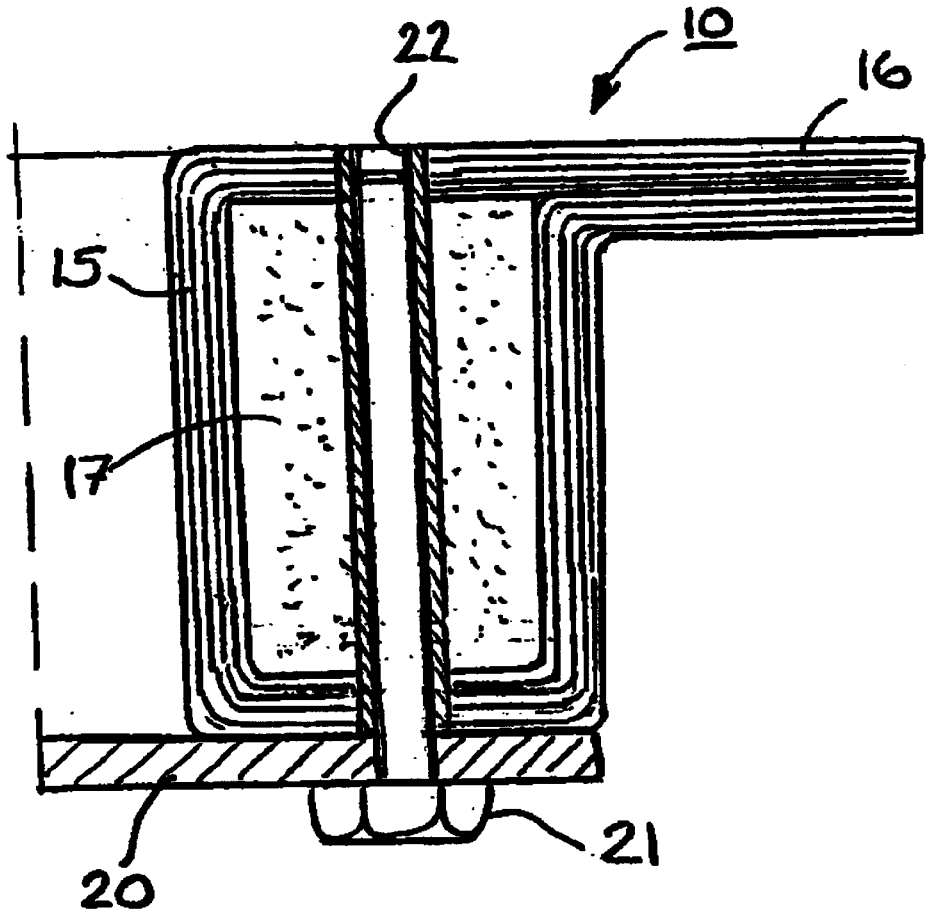

In FIG. 4, the ring member 10 for a wrapping machine comprises one or more threaded sleeves 22 laminated inside the box-shaped portion 15 of reinforced plastic. In this case, the feed apparatus 20 for a plastic film band roll is attached to the ring member 10 with bolts 21 screwed into the threaded sleeves 22.

Figure 5:
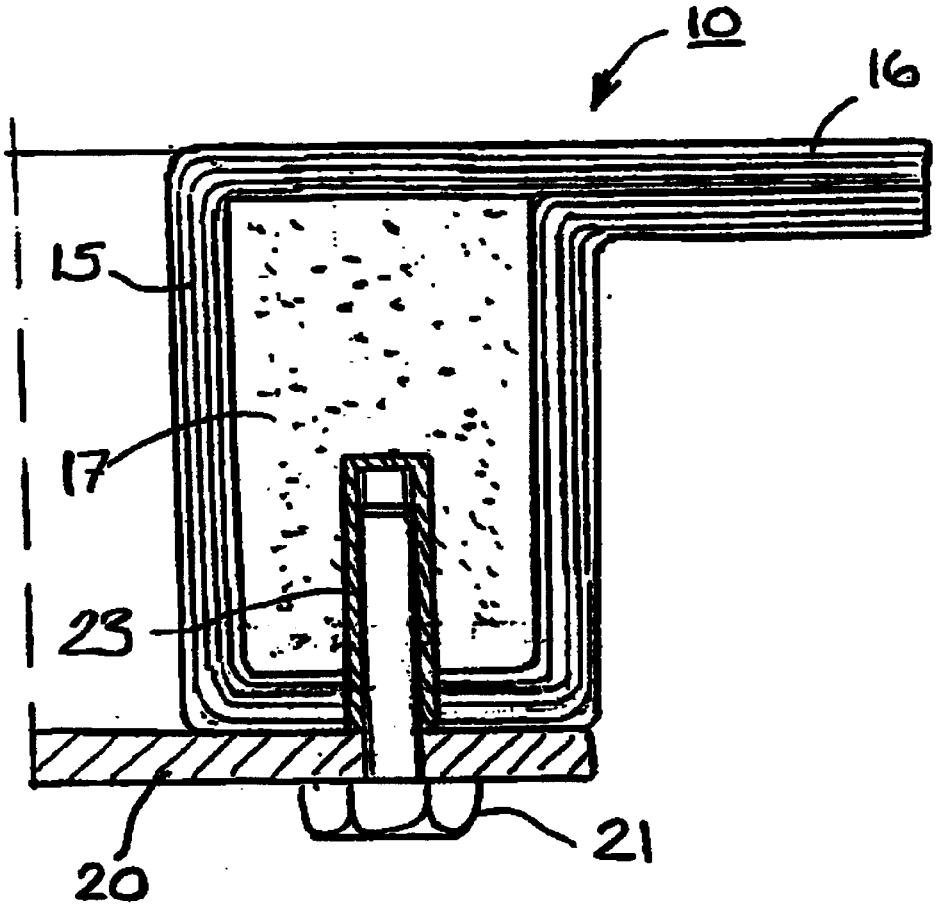

In FIG. 5, the ring member 10 for a wrapping machine comprises one or more threaded parts 23 laminated inside the box-shaped portion 15 of reinforced plastic. In this case, the threaded part 23 only extends e.g. halfway through the box-shaped portion 15. The feed apparatus 20 for a plastic film band roll is attached to the ring member 10 with bolts 21 screwed into the cup-like threaded parts 23.

Figure 6:
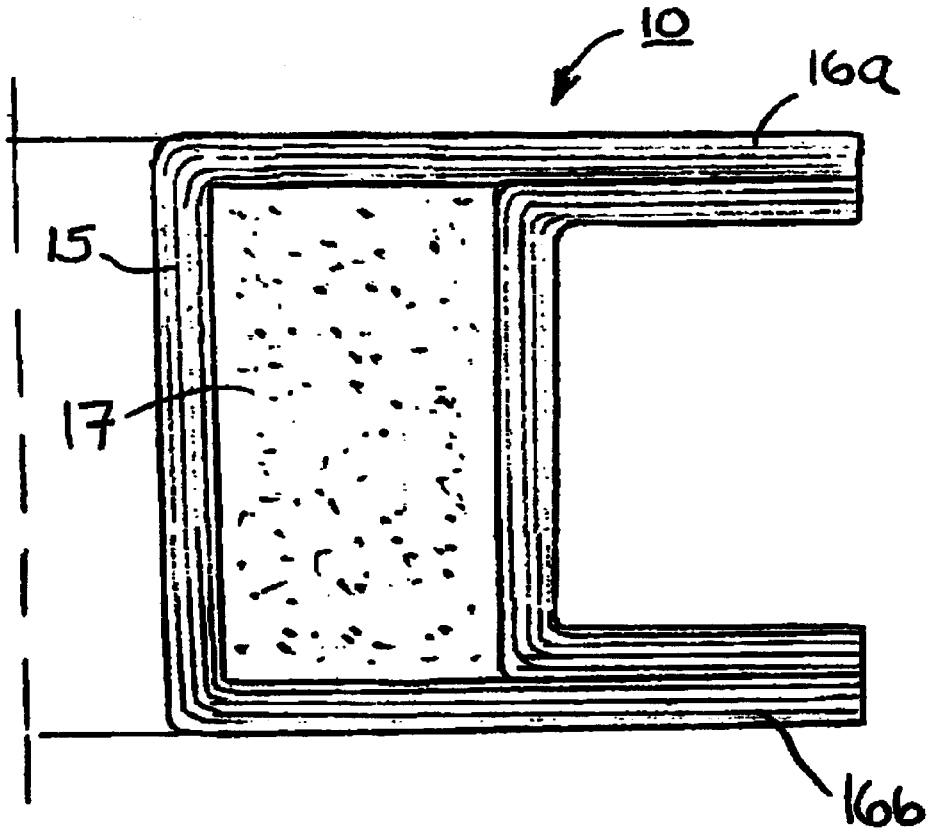

FIG. 6 presents a cross-section of the ring member 10 in which the ring member 10 consists of a box-shaped portion 15 and two horizontal flanges 16*a* and 16*b* integrated with it. In this case, the support rollers engage the ring member 10 from outside, between the flanges 16*a* and 16*b*. The support rollers under the ring member engage the lower surface of the lower flange 16*b*. The box-shaped portion 15 and the flanges 16*a* and 16*b* have several reinforcing fibre layers, and filler material 17 Is provided inside the box-shaped portion 15. The feed apparatus 20 for a plastic film band roll can be connected to this embodiment by any one of the methods described above.

Figure 7:
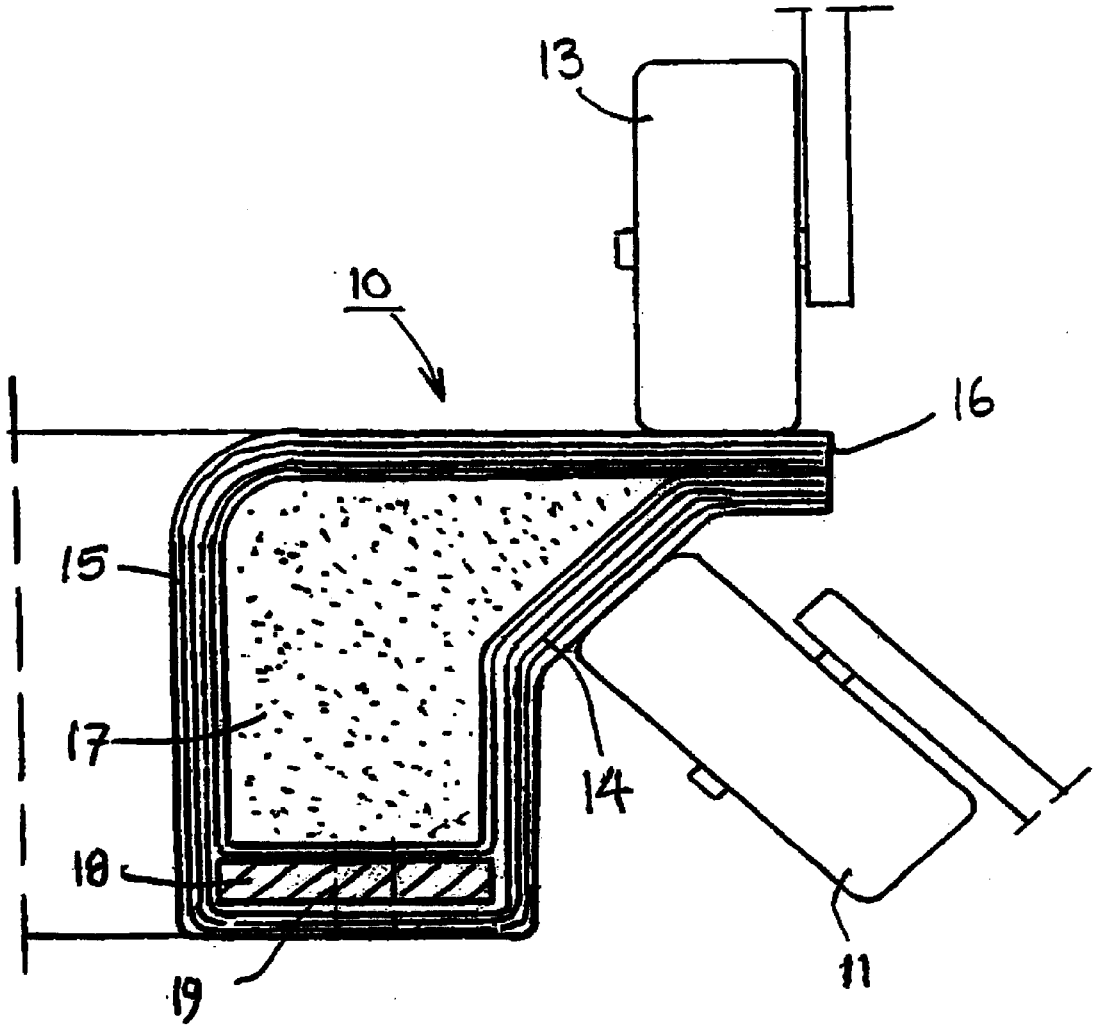

FIG. 7 presents a cross-section of a ring member 10 of reinforced plastic for a wrapping machine in which one 14 of the walls of the box-shaped portion 15 is in an oblique position. This wall 14 is preferably at an angle of 45° to the horizontal and vertical planes. In this case, a support roller 11, also mounted at an angle of 45°, engaging this wall 14 replaces separate horizontal and vertical support rollers The oblique wall 14 also has the effect of making the structure of the box-shaped portion 15 advantageously more rigid than a rectangular box-shaped structure.

Figure 8:
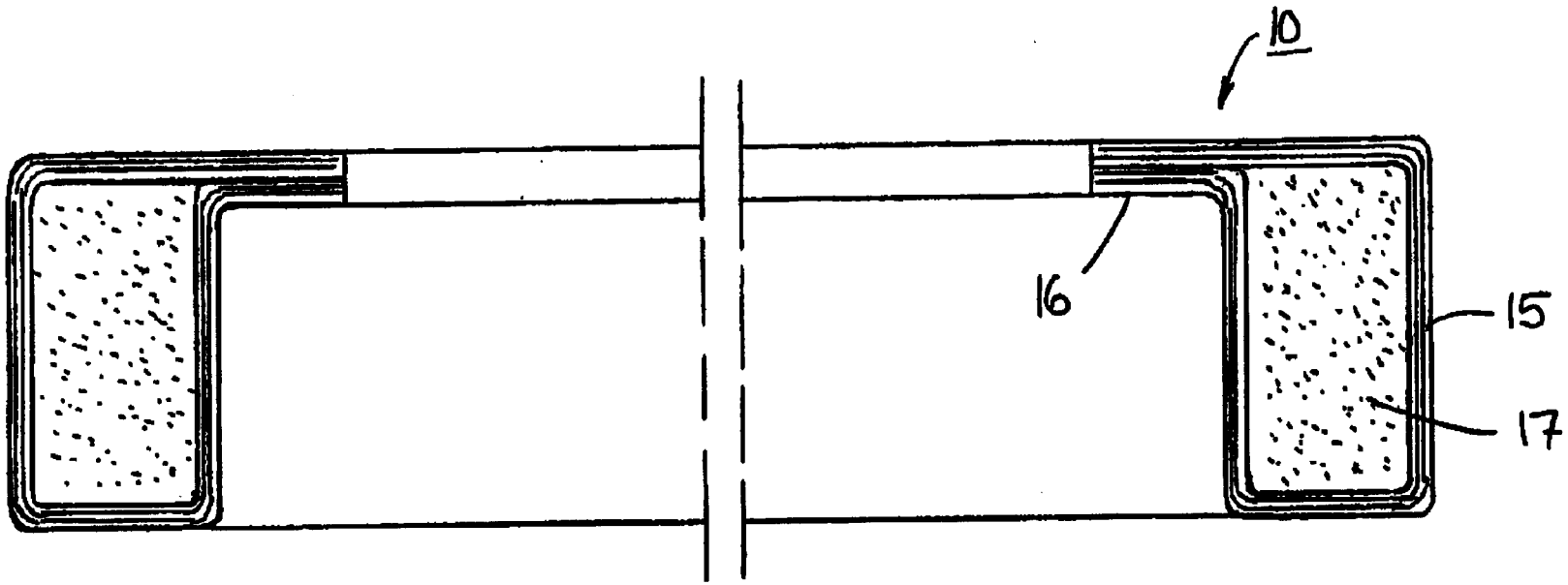

FIG. 8 illustrates an embodiment of the ring member 10 in which the flange 16 of the box-shaped portion 15 is oriented in a direction toward the centre of the ring member 10. In this case, the support rollers of the ring member 16 can be placed on the interior side of the ring member, whereas normally the flange 16 and support rollers are placed on the outer side the ring member 16. As the centrifugal force tends to stretch the ring member 16 outwards when the ring member 16 is rotating at a high speed, the load applied to the support rollers can be reduced by placing the rollers on the interior side.

ADDITIONAL REMARKS

It is obvious to the person skilled In the art that different embodiments of the invention may vary within the scope of the claims presented below.

What is claimed is:

1. Ring member (10) of reinforced plastic construction for a wrapping machine, said ring member being of a mainly ring-shaped form and rotatable, characterized in that the ring member (10) of reinforced plastic construction for a wrapping machine comprises, in cross section a box-shaped portion (15) having a plurality of reinforcing fibre layers laminated in different directions upon a core part (17) of cellular plastic material, that the box-shaped portion (15) of the ring member (10) is provided with a reinforcement (18) laminated inside the reinforced plastic layers in the box-shaped portion, said reinforcement made of steel, and that the reinforcement (18) is a ring of the same form with the ring member (10) or its length only equals part of the length of the ring member;

means on said ring for connecting a plastic film roll of said wrapping machine to said ring.

2. Ring member (10) as defined in claim 1, characterized in that at least one (14) of the reinforced plastic walls of the box-shaped portion (15) of the ring member (10) is in an inclined position deviating form a vertical or horizontal plane.

3. Ring member (10) as defined in claim 2, characterized in that the reinforced plastic wall (14) of the box-shaped portion (15) of the ring member (10) is in engagement with a support and/or guide roller (11) of the ring member and is inclined at an angle of preferably 45° relative to the vertical plane.

4. Ring member (10) as defined in claim 3, characterized in that the reinforced plastic box-shaped portion (15) of the ring member (10) comprises at least one flange (16) made of the same reinforced plastic material for the support and/or guide rollers (12, 13).

5. Ring member (10) as defined in claim 4, characterized in that the flange (16) of the ring member (10) is preferably oriented in a direction from the box-shaped portion (15) inward toward the centre of the ring member or in the opposite direction, outward from the ring member.

6. Ring member (10) as defined in claim 1, characterized in that the box-shaped portion (15) of the ring member (10) comprises two or more flanges, which may either be all oriented in the same direction, partially in different directions or they all may be oriented in different directions.

7. Ring member (10) as defined in claim 1, characterized in that the reinforcing fibres in the box-shaped portion (15) and/or flanges of the ring mem-ber (10) are carbon fibres, the binding agent binding the reinforcing fibres is preferably epoxy resin, and that the core part (17) inside the box-shaped portion is made of foamed polyurethane plastic.

8. Ring member (10) as defined in claim 1, characterized in that said correcting means comprises at least one bolt (21) going through the box-shaped portion (15) of the ring member (10) and its core part (17), by means of which bolt the feed apparatus (20) of a plastic film band roll can be connected to the ring member.

9. Ring member (10) as defined in claim 1, characterized in that said correcting means comprises at least one threaded sleeve (22) or cup-like threaded part (23) laminated inside the box-shaped portion (15) of the ring member (10), to which threaded sleeve or part the feed apparatus (20) of a plastic film band roll is connected with bolts (21).

10. Ring member (10) as defined in claim 1, characterized in that the reinforcement (18) inside the ring member (10) is provided with at least one threaded hole (19) for the attachment of a feed apparatus (20) for a plastic film band roll.

11. Ring member (10) as defined in claim 4, characterized in that said connecting means comprises one or more guide or support rollers connected either directly or via an adapter element to the box-shaped portion (15) or flange (16) of the ring member (10).

* * * * *